United States Patent [19]

Ducol et al.

[11] 4,314,462

[45] Feb. 9, 1982

[54] METHOD AND APPARATUS FOR GUIDING A FLEXIBLE TUBE BETWEEN ANNULAR AND FLATTENED CROSS SECTION

[75] Inventors: Jean-Paul Ducol, Les Sauvages; Jacques Mesny, Troyes; Julien Warret, Saint-Andre-les-Vergers, all of France

[73] Assignees: Institut Textile de France; Agence Nationale de Valorisation de la Recherche (ANVAR), both of France

[21] Appl. No.: 6,518

[22] Filed: Jan. 25, 1979

[30] Foreign Application Priority Data

Feb. 2, 1978 [FR] France ..... 78 02944
Sep. 19, 1978 [FR] France ..... 78 26847

[51] Int. Cl.[3] ..... D04B 15/88
[52] U.S. Cl. ..... 66/152; 66/153
[58] Field of Search ..... 66/149 R, 151, 152, 66/153; 139/291 R; 26/80, 85

[56] References Cited

U.S. PATENT DOCUMENTS

| | | | |
|---|---|---|---|
| 265,296 | 10/1882 | Adgate | 66/151 X |
| 1,736,387 | 11/1929 | Barratt | 66/151 |
| 2,585,762 | 2/1952 | Gardner | 66/151 X |
| 3,337,107 | 8/1967 | Catallo et al. | 26/80 X |
| 4,011,128 | 3/1977 | Suzuki | 26/85 X |

FOREIGN PATENT DOCUMENTS

| | | | |
|---|---|---|---|
| 1218107 | 6/1966 | Fed. Rep. of Germany | 66/149 R |
| 1228021 | 11/1966 | Fed. Rep. of Germany | 66/149 R |
| 2130660 | 12/1972 | Fed. Rep. of Germany . | |
| 1044454 | 6/1953 | France | 26/80 |
| 51-102153 | 9/1976 | Japan | 66/151 |
| 683075 | 11/1952 | United Kingdom . | |
| 940339 | 10/1963 | United Kingdom | 26/85 |
| 575389 | 10/1977 | U.S.S.R. | 66/152 |

*Primary Examiner*—Wm. Carter Reynolds
*Attorney, Agent, or Firm*—Lewis H. Eslinger

[57] ABSTRACT

A tube of flexible material moving longitudinally undergoes transition between annular cross section and flattened straight cross section, without change in the length of perimeter of its cross sections, by one stage of changing between the annular cross section and a rectangular cross section, and another stage of changing between that rectangular cross section and the flattened cross section through successively longer and narrower rectangular cross sections. The method is applicable to material produced by a circular knitting machine. Preferably there is a polyhedral guide within the tube.

19 Claims, 13 Drawing Figures

METHOD AND APPARATUS FOR GUIDING A FLEXIBLE TUBE BETWEEN ANNULAR AND FLATTENED CROSS SECTION

The present invention concerns a method and an apparatus for guiding a tube with a flexible wall between a first zone where it has a cross section of annular shape and a second zone where it is flattened.

The invention more particularly concerns a method of guiding a tube with a flexible wall while travelling between a first fixed transverse plane where the cross section of the tube is annular, and a second fixed transverse plane, where the cross section of the tube is flattened and straight.

In particular the invention has as its object to put forward a process enabling carrying out of the transition between a tube shape of annular cross section and a flattened shape of tube, or vice versa, while avoiding at the same time the formation of folds in the wall of the tube and the appearance of swelling deformation in the direction of the generatrices of the tube.

The problem according to the invention consists in guiding the tube over a certain zone extending from the second plane in a direction towards the first plane, so that in this zone, on the one hand the length of the travel of the generatrices of the tube should be constant over all the periphery of the tube and, on the other hand the perimeter of the cross section of the tube should be constant over all the axial length of the tube.

This object is attained according to the invention, in that one guides a portion of tube defined on the one hand by the second plane and, on the other hand, by a third transverse plane situated at a fixed station in the travel of the tube between the said first and second planes, so that this portion has the shape of a surface formed by side faces of a solid defined by a straight edge, called the summit, coinciding substantially with the flattened straight section of the tube at the level of the second plane, and by a base face which is situated opposite this edge, which extends in the said third plane, which is coaxial and parallel to this edge, and which has a perimeter of length p substantially equal to twice the length of the summit edge, the said side faces connecting the said perimeter to this edge, and being shaped in such a way as to constitute together the surface which is substantially able to be developed into a rectangle, of which two opposite sides are orientated along the generatrices of the tube, provided that, over all the axial length of the said section, the cross section of the tube maintains a constant perimeter and, over all the periphery of the tube, the paths of the generatrices of this tube, between the said second and third planes, are equal.

Advantageously, the tube is guided by acting mainly on the internal surface of the said portion of tube.

Advantageously, the base face is a rectangle of which two opposite sides are parallel to the summit edge.

Advantageously, the solid is a polyhedron.

Advantageously, the base face of the solid is a square.

Advantageously, the perimeter p of the base face is substantially equal to the perimeter of the cross section of the tube at rest.

This process is advantageously put into practice in an apparatus comprising means for causing a tube to travel with its axis substantially straight between a first fixed transverse plane where the cross section of this tube is annular and a second fixed transverse plane where the cross section of the tube is flattened and straight, with the aid of a device which is characterised according to the invention in that it comprises a rigid guiding means, called the internal guiding means, placed at a fixed station in the interior of the tube between the said second and third planes, this means having the general shape of the solid defined above, and for this purpose presenting at least six elements of which four, called the first elements, constitute the four apices of the base face of the said solid, and of which the other two elements, called second elements, constitute the two ends of the summit edge, and in that each first element of the guiding means is rigidly connected by an element of the structure itself to the nearer second element.

Advantageously, the device comprises control means for controlling the length of the sides of the base face and that of the summit edge.

Advantageously, the control means are means for simultaneously controlling the position of each first element of the guiding means in a manner to control the length of the sides of the base face without displacing the centre of that face, and/or for controlling simultaneously the position of each second element in such a way as to control the length "a" of the summit edge without displacing the centre of that edge.

Advantageously, the first elements defining each edge of the base face parallel to the summit edge are connected two by two by an element of the structure itself.

Advantageously, the guiding means comprises two straight rigid bars constituting the two sides of the base face parallel to the summit edge.

Advantageously, the device also comprises two substantially straight rigid elements, called external guiding elements, placed at a fixed station, outside the tube and constituting the two sides of the base face which are orthogonal to the summit edge.

Advantageously, the external guiding elements are each constituted by a roller mounted freely on an axle at a fixed station.

Advantageously, the axles of these rollers are connected to one another, at each end, by a respective element of the structure.

Advantageously, the elements of the structure mentioned above, namely, the element of the structure connecting each first element to the near second element, the element of the structure connecting together the first elements two by two, and the element of the structure connecting the axles of the rollers together are each constituted by a straight bar.

One of the fields of application of the invention is that of the flattening ready for rolling up of the knitted tube produced by a circular knitting machine.

In circular knitting machines, a pull is exerted on the knitted material coming from the needles in tubular shape, by means of feed rollers which are driven. The knitted material emerging flat from the feed rollers is generally rolled up on a take-up support.

One of the principal difficulties encountered lies in the transition from the tubular shape to the flattened shape. To facilitate this transition and permit the rolling up of the knitted material flat without wrong folds, there has already been proposed a compensating device for expanding the knitted material during the travel of the latter, between the exit from the knitting machine and the feed rollers. FIG. 1 shows very schematically such a known device. Hoops 2 facilitate the flattening of the knitted material 1 without wrong folds, for rolling up on the support 3. Spreading members 4, performing the function of an expander, permit the knitted material to be presented flat and at the desired width between the feed rollers 5.

These known devices produce defects on the knitted material which are often serious. Certain defects are deformations of the material in width, which depend upon the adjustment of the stretching device, on its shape, and on the driving force on the material, and deformations in height which are a function of the driving force and the irregularity of which, seriously inconvenient, depends on the form of the compensator-stretching device.

Other faults consist in distortions of the rows of stitches, at C, and the defect of a nose, visible at B, in the lateral folds of the material.

All these defects have a more or less permanent character, which detracts from the quality of the material and poses serious problems at the stages of finishing, cutting out, and making up. There arise particularly problems of reproducibility of dyeing and finishing treatments, and losses of material in cutting out due to the dimensional variations in length and width. The defects mentioned above can be latent in the case of striped materials, jacquard materials or other patterned materials, because of the problems posed by matching and the joining of rows and figures. One may even be led to carrying out cutting singly and not in multiple, from which comes a very low productivity.

One must also note that the lack of uniformity and the intensity of feeding tensions in the material existing with the known compensator-stretching devices can have troublesome consequences even on the knitting members, notably on the life of the needles, guides and cams.

The present invention has also as its object to put forward a method and devices enabling one to avoid the appearance of the defects mentioned above, to eliminate the problems posed by the existence of these defects in the material, and more particularly of the defects of distortion of the rows of stitches, and to make the tension of pulling—or feeding—uniform all round the tube of material. The invention has also as its object to put forward a method and devices thanks to which it is possible to eliminate the defects of deformation in width, to reduce to a minimum the deformations in height, and to work within a wide range of drawing tensions, particularly including low tensions.

For these purposes, in the application of the method according to the invention, in a circular knitting machine comprising a circular guide and an output device comprising a pair of feed rollers, this device being situated downstream of the said guide along the route of the said tube of material and defining a starting line for the flattened tube of material, a line which is coplanar with and perpendicular to the axis of the guide, this application is characterised in that the summit edge substantially coincides with the starting line of the output device while the base face is arranged coaxially with the guide, and is situated downstream of a zone where the tube of material has substantially its unstressed diameter.

Other features and advantages of the invention will appear from reading the description given below, which is illustrative but not limitative, with reference to the accompanying drawings in which:

FIGS. 1 and 2, already described, are views relating to the state of the art and show schematically a known compensating-stretching device for a tube of material produced by a circular knitting machine and the defects of distortion appearing in the flattened material;

Figure 3:
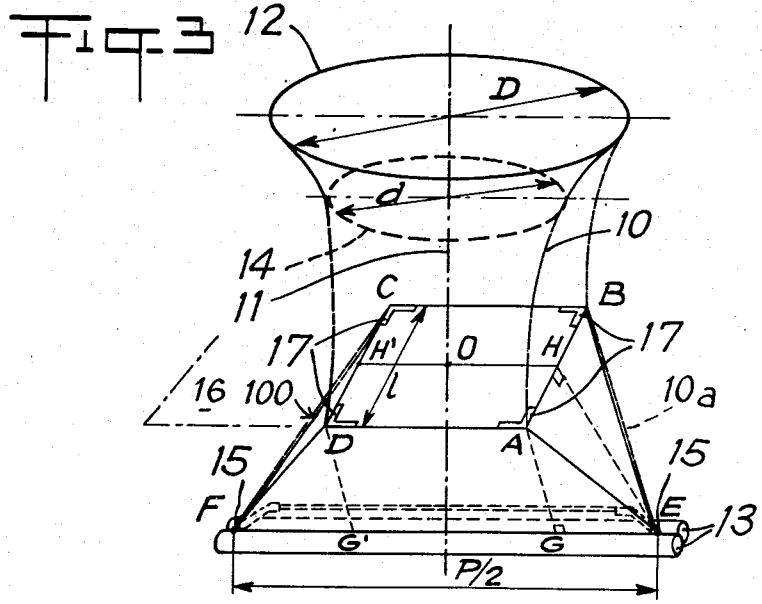
FIGS. 3 and 4 show very schematically, respectively in perspective and in half view from below, the principle of one embodiment of a device according to the invention.
Figure 4:
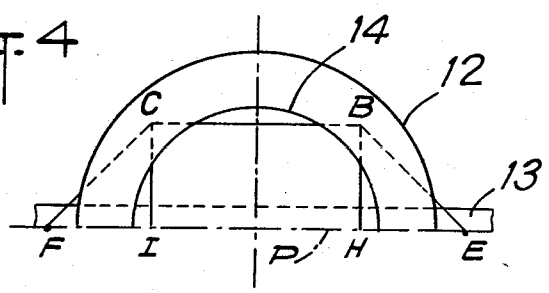
Figure 1:
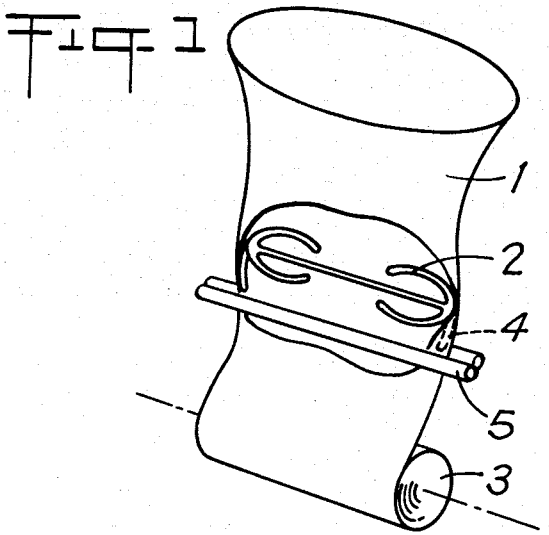
Figure 2:
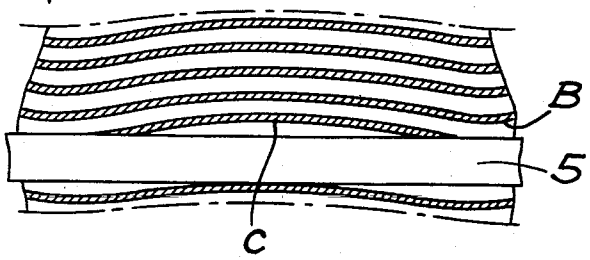

In FIGS. 3 to 7 there has been shown schematically a tube of knitted material 10 with a vertical axis 11 from its leaving the needles of a circular knitting machine up to its passing flattened between the feed rollers 13. The said needles are distributed on a circular guide or bed which is shown schematically by a circular line 12 in FIGS. 3 to 7. The guide 12 has as its axis the axis 11. The flattened tube, pulled by the rollers 13, is thereafter rolled up on a take-up support (not shown). The circle 14, of diameter "d" and of perimeter $p=\pi d$, represents the level at which the material reaches a state of equilibrium after contraction on leaving the knitting machine. The reduction in diameter of the tube 10 between the circles 12 and 14 may amount to 30% of the value of the diameter "D" of the circle 12. This perimeter p is referred to below as "equilibrium perimeter" or "perimeter at rest".

Separating elements 15 are arranged symmetrically relatively to one another in relation to the axis 11 in the plane of symmetry P defined by the axis 11 and the line of the nip 13*a* of the feed rollers 13, this line 13*a* being perpendicular to the axis 11 and intersecting the latter.

The distance separating the spreading elements 15 from one another is equal to p/2, the material being thus flattened with a perimeter equal to that which it has in its state of equilibrium.

The separating elements 15 are situated as close as possible to the line of nip 13*a* of the rollers 13, to guide the material between these rollers in the best conditions.

According to the invention, the tube of material 10 has a portion 10*a* thereof guided, which portion 10*a* is defined, on the one hand, by the line of nip 13*a* of the feed rollers 13 and, on the other hand, by a plane 16 transverse to the tube 10 situated between the level of the circle 14 and the feed rollers 13, so as to impose on the lines of stitches (generatrices) of the tube 10 over this portion 10*a* paths of travel of length substantially equal over all the peripery of the said tube 10.

For this purpose, this portion 10*a* is guided so that it presents the form of a surface which can be developed into a rectangle of which two opposite sides coincide with generatrices of the tube 10, of which a third side is constituted by the cross section of the tube 10 in the plane 16, and of which the fourth side is constituted by the cross section of the flattened tube 10 between the rollers 13.

This surface is the side surface of a solid defined by six apices A to F, of which four apices A, B, C, and D form the four corners of a rectangular frame of perimeter equal to p, this frame being situated in the plane 16, having its centre O on the axis 11 and having two opposite sides AD and BC parallel to the line of nip 13*a* of the feed rollers 13.

The points E and F are the ends of the segment along the length of which the material is flattened between the rollers 13. These points E and F coincide substantially with the spreading elements 15.

In the example shown, the solid A to F is a polyhedron with six apices.

The guiding of the portion 10*a* following the polyhedron with six apices A to F enables one to ensure paths of travel of equal lengths between the plane 16 of the frame A, B, C, D and the line of nip 13*a* between the rollers 13 to the lines of stitches guided along the non-horizontal faces of this polyhedron.

In fact, with l indicating the length of the sides AB and CD, G and G' being the projections of the apices A and D on EF, and H and H' being the projections of the apices E and F respectively on AB and CD, it will be noted from FIG. 3 that:

the distance AH is equal to l/2 because H for reasons of symmetry is the centre of AB, the distance GE is equal to G' F, that it to say to half the difference between p/2 (distance EF) and GG'. Consequently, $GG'=AD$ and, the perimeter of A, B, C, D being p, $GG'=AD=p/2-l$. One thus has $GE=\frac{1}{2}(p/2-GG')=l/2$.

The right angled triangles AEH and AEG have common hypotenuses, and two equal sides (AH and GE). These triangles are therefore equal.

The same reasoning applies to the triangles BEH, BEG, DFH', DFG', CFH' and CFG'.

The development of the four non-horizontal faces of the polyhedron ABCDEF, a development produced by aligning the points ABCD, is thus a rectangle of which the large sides have a length equal to p and the small sides have a length equal to EH.

The distance travelled by each line of stitches between the frame ABCD and the drive rollers is thus indeed constant.

Moreover, the transverse cross sections of the polyhedron ABCDEF, perpendicular to the axis 11, are rectangles of a perimeter which is constant and equal to p. In other words, the side faces are shaped so as to form a polygon and preferably, a rectangle as shown in FIG. 3, in any cross-sectional plane parallel to the plane of the rectangular frame defined by apices A–D.

The conditions of non-distortion of the lines of stitches, and of non-deformation in width are thus indeed respected between the plane 16 of the frame ABCD and the rollers 13.

The drawing tension exerted on the material is thus indeed uniform all round the latter. This tension may, moreover, be chosen within a wide range, notably towards low values.

It is to be noted that the conditions of equal lengths of paths for the lines of stitches and of constant perimeter for the transverse section of the tube of material, between the planes 16 and the feed rollers 13, are respected simply by giving to the frame ABCD the form of a rectangle of perimeter equal to p. Nevertheless, the applicants have established that the travel of the material from the level of the circle 14 as far as the transverse plane 16 takes place under the best conditions when the rectangle is a square.

Moreover, it is desirable not to impose on the tube of material 10 too rapid a transition from the circular shape (circle 14) to the rectangular shape (frame ABCD), then from the latter to the flattened shape (rollers 13). That is why, preferably, the frame ABCD is arranged substantially in mid-travel between the plane of the circle 14 and the line of nip 13*a* between the feed rollers 13.

The guiding according to the invention of the portion 10*a* is carried out, according to FIGS. 3 to 7, by means of a guiding means 100 called the internal guiding means, arranged at a fixed station in the interior of the tube 10, during the travel of the latter between the plane 16 and the driving rollers 13.

According to FIG. 3, this guiding means comprises a first section including four elements in the form of a square 17 each constituting an apex A, B, C, D, and a second section including two spreading elements 15 each constituting an apex E, F. The elements 15 and 17 are held rigidly relatively to one another by edge means not shown in FIG. 3, so as to be able to withstand the forces which are applied to them by the tube 10, while travelling along its axis 11.

These elements 15 and 17 thus form a unitary mechanical assembly which is fixed to a stationary frame by means not shown in the drawings.

The internal guiding means 100 is sufficient to guide the portion 10*a* along the non-horizontal surfaces of the solid A to F, only if the distance between the circle of the guide 12 and the line of nip 13*a* is not too small.

In general, to obtain a perfect guiding of the said portion 10*a*, one should use an additional guiding means placed outside the tube, as is described below with reference to FIGS. 5 to 7.

Figure 5:
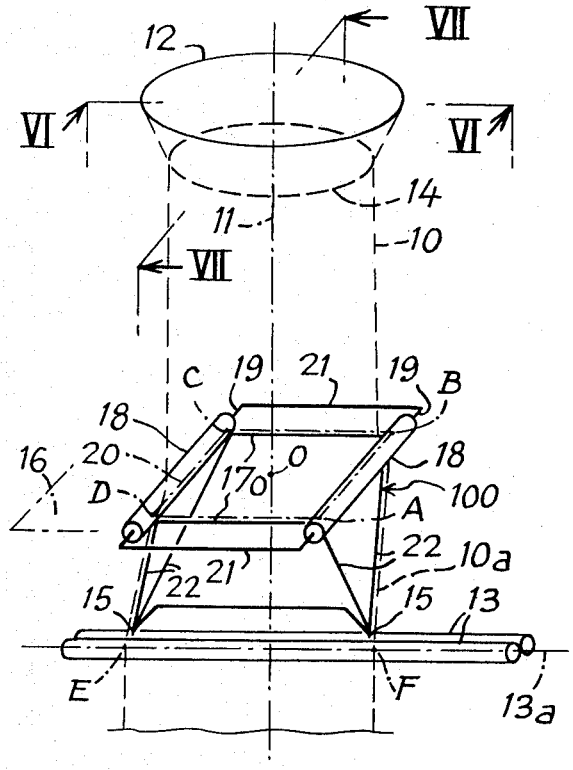
FIG. 5 is a schematic perspective view of the guiding device according to a second embodiment of the invention.
Figure 6:
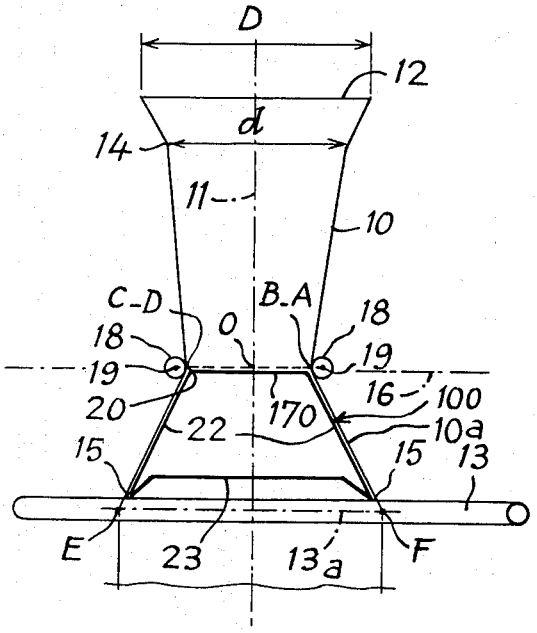
FIG. 6 is a vertical section on VI—VI in FIG. 5.
Figure 7:
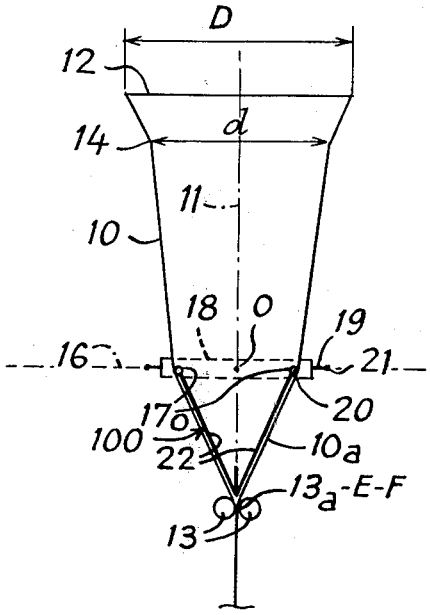
FIG. 7 is a vertical section of FIG. 5 in the plane VII—VII perpendicular to the plane VI—VI.

According to the embodiment shown in FIGS. 5 to 7, the internal guiding means 100 comprises a first section including two straight rigid horizontal bars or elements 170 each constituting a respective side AD and BC of the frame ABCD; the two other sides AB and CD of the frame ABCD are each constituted by a straight roller 18 mounted freely on a horizontal axis 19 perpendicular to the bars 170.

The lines of contact of the elements 170 and 18 with the tube 10 constitute a rectangular frame 20, the apices of which are the points A, B, C, and D.

The level of the axles 19 can be slightly above that of the bars 170.

The bars 170 are maintained in a position which is fixed relative to the guide 12 and to the axles of the rollers 13 by fixing means not shown.

The axles 19 of the rollers 18 are connected to one another, at their two extremities, by rigid bars or connecting members 21, the elements 18, 19 and 21 forming a frame surrounding the tube of material 10. This frame 18, 19, 21 may either be free, the rollers 18 resting freely on the periphery of the tube 10, or maintained in fixed position relative to the guide 12 and to the axes of the rollers 13, by fixing means not shown.

Thus the device 100, 17, 18, 19, 21 has as its function to guide the tube 10 from all sides so that it has, in the horizontal plane 16 constituted by the bars 170, a transverse cross section 20 fixed in dimensions and in position relative to the guide 12 and to the axes of the feed rollers 13, this section 20 having substantially the form of a rectangle of which two opposite sides AD and BC are substantially parallel to the line of nip 13*a* of the feed rollers 13, the centre 0 of which is on the axis 11, and the perimeter of which is equal to p.

In the example shown, the elements 15 are each constituted by the meeting point of the lower ends of edge means constituted by rigid straight bars 22 of guiding means 100, these bars forming the four oblique lateral edges of the solid A, B, C, D, E, F that is, as shown in FIG. 5, bars 22 connect each of the four apices A, B, C and D to the nearest apex E or F of the second section.

A horizontal bar 23 bent downwards at its two ends connects together the meeting points 15 between two adjacent oblique bars 22.

Thus the solid—or polyhedron—A, B, C, D, E, F, constituted by the elements 15, 170 and 18 provides, between the plane of the frame 20 and the line of nip 13*a* between the rollers 13, paths of equal length to the lines of stitches guided along the four non-horizontal faces of this polyhedron.

Moreover, the transverse cross sections of the polyhedron A, B, C, D, E, F, perpendicular to the axis 11, are rectangles with perimeters which are constant and equal to p.

The conditions of non-distortion of the rows of stitches, and of non-deformation in width are thus indeed respected between the plane of the frame 20 and the rollers 13.

The tension of drawing—or of feed—exerted on the material is thus very uniform all round the latter. This tension may, moreover, be chosen within a large range, notably towards low values.

As shown by FIGS. 3 to 7, the tube of material 10 takes up, between the plane of the frame 20 and the rollers 13, the shape of the polyhedron A, B, C, D, E, F of which the apices are constituted by the elements 15, 17 and 18 and no distortion of the rows of stitches is visible. It will be noted that the presence of the device 100, 18, 19, 21 causes a lengthening of the path of all the lines of stitches.

It is advantageous to make the device according to the invention in such a way as to permit its adjustment to suit it to different values of p.

The guiding square 20 is for this purpose able to be changed while remaining similar in relation to its centre 0. In the example shown, this can be carried out by using telescopic bars 170, 21, 22 and 23.

When one varies the length of one of the sides of the square 20 by a given quantity, it is necessary to vary the distance between the separating elements 15 by double this quantity.

For this purpose, the bars 22 are hinged, at their two extremities, respectively to the elements 170 and 23.

Figure 8:
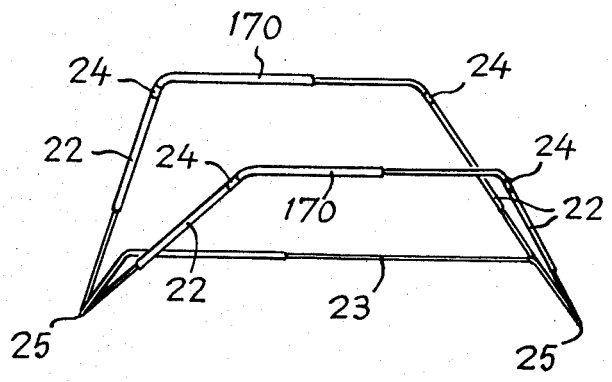
FIG. 8 is a perspective view of a guiding device which can be utilized with the above first and second embodiments of the invention.
Figure 9:
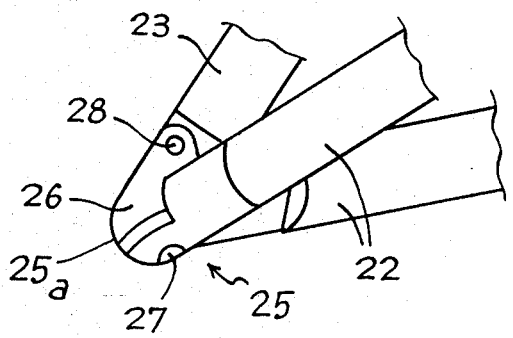
FIG. 9 is a perspective view of a joint of the guiding device of FIG. 8 according to one embodiment of this invention.

For example, as shown by FIGS. 8 and 9, the upper horizontal bars 170 and the oblique bars 22 are connected together by resilient rubber joints 24, which permit deformations in all directions.

At the lower part of the device there are hinges 25, each permitting at the same time the variation of the length of the bar 23 and the variation of the angles formed by the adjacent bars 22.

The hinge 25 (FIG. 9) is composed of a hub 26 where the bars 22 are hinged about the axis 27, while the bent bar 23 is hinged about the axis 28.

The lower part of this hinge 25 is rounded at 25*a*, as shown in FIG. 9, thus forming a portion of a sphere, and preserves this shape whatever be the adjustment of the device.

Figure 10:
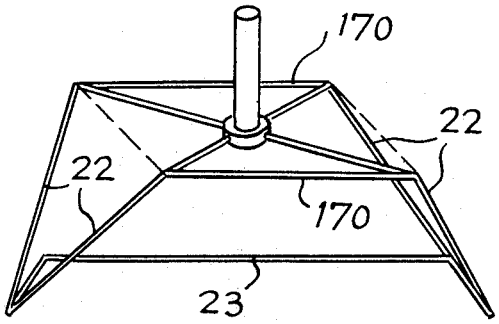
FIG. 10 is a perspective view of another embodiment of the guiding device which can be utilized with the above first and second embodiments according to the invention.

FIG. 10 shows an embodiment of the device 170, 22, 23 without any adjusting point, where all the bars are assembled together at fixed points, for example by welding.

Such an embodiment, of which the mechanical simplicity is evident, may be suitable for fitting on knitting machines on which one produces pieces of material the widths of which are constant. The dimensions of the apparatus are, in this case, set once and for all for this kind of material.

Figure 11:
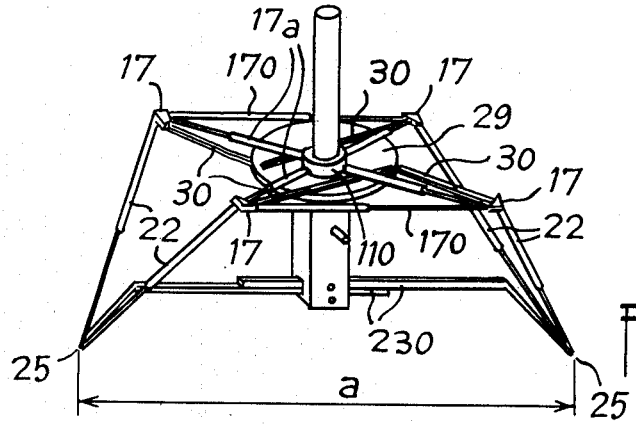
FIG. 11 is a perspective view of still another embodiment of the guiding device which can be utilized with the above first and second embodiments according to the invention.

FIG. 11 shows schematically a device in which the upper part is adjustable by means of a crank and rod device. When one turns the upper plate 29 in the form of a circular disc, for example by means of a crank handle controlling a system of a wheel and an endless thread, the rods 30 cause a similar enlargement or reduction of the upper rectangle defined by the telescopic bars 170. The lower part of the device is adjustable in width, for example by means of sliding components 230, and can be locked in position.

The checking of the adjustment of the upper and lower part is made easy by the marking of scales not shown.

Figure 12:
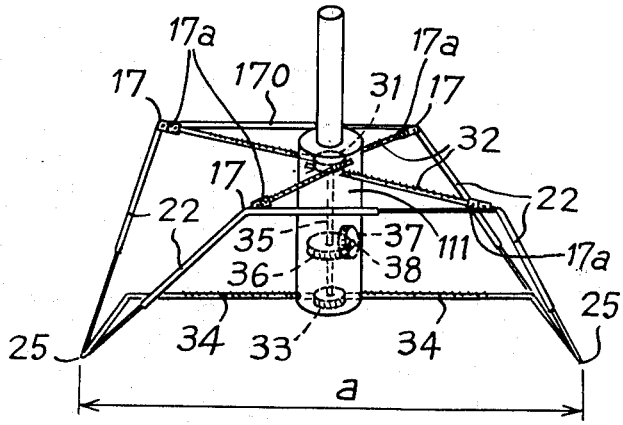
FIG. 12 is a perspective view of yet another embodiment of the guiding device which can be utilized with the above first and second embodiments according to the invention.

FIG. 12 shows an embodiment only comprising one central point of adjustment which permits one to turn at the same time one or more upper pinions 31 driving racks 32 controlling the enlargement or the reduction of the upper rectangle and one or more lower pinions 33 driving rack 34, permitting enlargement or reduction of the length "a" of the lower edge of the device. The diameter of the pinions 31 and 33 is calculated in such a way that the simultaneous variations of the dimensions of the upper rectangle and of the lower width "a" shall be compatible and satisfy the conditions for proper functioning of the device.

The pinions 31 and 33 are each keyed to one end of a common vertical shaft 35 on which is also keyed, between the said pinions 31 and 33, a third pinion 36 engaging at right angles with a fourth pinion 37 having at its centre a control socket 38.

The device shown in FIG. 11 functions in the following manner: the rotation of the plate 29 around its axis separates or brings together the ends 17 of the telescopic bars 170 thanks to the rods 30 which are each hinged, on the one hand on the plate 29 and, on the other hand on a respective end 17. Moreover, each end 17 is guided so as to move in a predetermined straight line, by means of telescopic rods 17*a* arranged along the diagonals of the upper rectangle, each rod 17*a* being fixed on the other hand to one end 17 and, on the other hand to a fixed frame 110.

The sliding components—or rods—230 replace the rod 23 in FIG. 10, sliding longitudinally in guides parallel to one another, not shown, provided in the frame 110.

The device shown in FIG. 12 functions in the following manner: by a rotation of the pinion 37 by means of the control socket 38 one simultaneously varies the dimensions of the upper rectangle and the length "a".

The racks 32 perform at the same time the guiding function of the telescopic rods 17*a* and that of the rods 30 in FIG. 11.

These racks are each hinged, at one end, on a respective end 17 by hinges 17*a* which are schematically shown in FIG. 12, and they are guided at their other end, in a slide—not shown—in a fixed frame 111. The racks 34 are guided in slides parallel to one another and slightly spaced from one another, in the frame 111.

Thus, the adjusting devices 29, 30, 17*a*, 230, 110 or 31 to 38, 111 permit adjustment of the length of the sides of the base face ABCD and the length "a" of the summit edge EF without displacing the centre 0 of the said base face, not the centre of the summit edge, the frame 110 or 111 being fixed.

Of course various modifications and additions could be made to the embodiments described above of a device according to the invention, without in that way going outside the scope of protection defined by the accompanying claims.

It will be noted in particular that the device according to the invention is suitable not only for standard circular knitting machines, in which case it is rotated with the drive rollers and the device for rolling up the flattened material, simultaneously with the guide, but also for knitting machines with rotating cams and fixed guides, in which case the devices for guiding, driving and rolling up the material are fixed.

Figure 13:
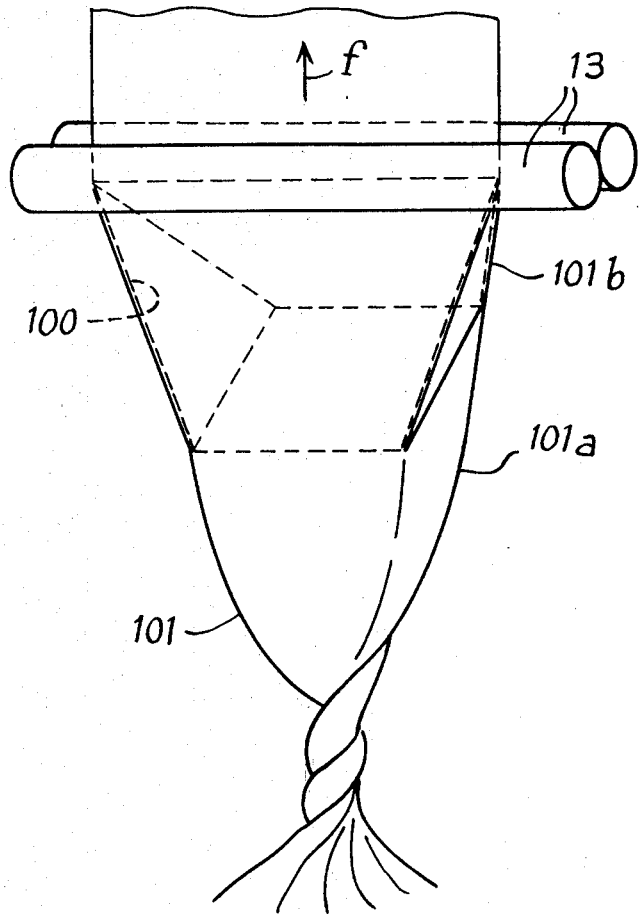
FIG. 13 is a diagrammatic view in perspective of this invention being used to untwist a tube of fabric.

FIG. 13 shows the application of the invention to apparatus for untwisting of a tube of fabric 101 coming from a treating station, for example a drying station, or before foularding in a plant for dyeing, for bleaching, for mercerising, or for finishing.

The tube 101 is driven in the direction of the arrow f by a pair of drive rollers 13, placed downstream from the supply 39.

Thanks to the interposition at a fixed station of an internal guiding means 100 within the tube 101 and between the rollers 13 and the part 101*a* of the tube, the portion 101*b* of the tube situated between the nip line 13*a* of the rollers 13 and the portion 101*a* is guided according to a surface which can be developed into a rectangle, in accordance with the method according to the invention, in consideration of which one permits the tube 101 to be flattened without wrong folds and without any of the deformations mentioned above. The means 100 is constructed and operated as described above with reference to FIG. 3, and to this means one can add an external guiding means, identical to the frame 18, 19 and 21 and mounted at a fixed station on the periphery of the tube 101 as described with reference to FIGS. 5 to 7, this external means being able also to serve to position and support the means 100.

According to another application of the invention, not shown, one uses two identical internal guide means such as 100, arranged spaced from one another along the travel of a tube of fabric. These two means are orientated in opposite directions relatively to one another.

If one desires to give to the tube between these means a flattened shape, one orientates the summit ridge of each means towards the other means.

If, on the contrary, one desires to give to the tube a straight annular cross section between these means, it is the base faces of the means which are turned towards one another.

We claim:

1. Method of guiding a tube having a flexible wall and extending between a first transverse plane in which the cross-section of the tube is annular and a second transverse plane in which the cross-section of the tube is linear, comprising the step of guiding a portion of the tube extending between the second plane and a third transverse plane situated between said first and second planes over a guiding means including a first section disposed in said third plane, said first section having a first set of four apices which are arranged within said tube so as to form a rectangular configuration, so that said portion is formed into a surface having side faces extending between a straight edge of said portion coinciding substantially with said linear cross-section of the tube in the second plane and a circumferential base of said portion which is situated opposite said edge and which extends in said third plane parallel to said edge, said base having a perimeter of a dimension substantially double that of the length of said edge, and said side faces being shaped so as to form a rectangle in any cross-sectional plane parallel to said second and third planes, said rectangle formed in any said cross-sectional plane parallel to said second and third planes having a perimeter equal to the perimeter of said circumferential base.

2. Method of guiding according to claim 1, in which said tube has an inner surface and said step of guiding includes guiding said tube primarily along the inner surface of said portion of tube.

3. Method of guiding according to claim 1, in which said side faces form a polyhedron.

4. Method of guiding according to claim 1, in which the base is a rectangle of which two opposite sides are parallel to the straight edge.

5. Method of guiding according to claim 4, in which the base is a square.

6. Method of guiding according to claim 1, in which said tube has a cross-sectional equilibrium perimeter between said first and third planes and the perimeter of said portion at the base is of a substantially equal dimension to the equilibrium perimeter.

7. Apparatus for guiding a tube having a flexible wall and extending between a first transverse plane in which the cross-section of the tube is annular and a second transverse plane in which the cross-section of the tube is linear, said apparatus comprising guiding means disposed in the interior of the tube between said first and second transverse planes for guiding a portion of said tube between said first and second planes, said guiding means including a first section disposed in a third transverse plane located between said first and second planes and having a first set of four apices which are arranged so as to form a rectangular configuration, wherein said portion of said tube is formed into a surface having side faces extending between a straight edge of said portion coinciding substantially with said linear cross-section of the tube in the second plane and a circumferential base of said portion which is situated opposite said edge and which extends in said third plane, said base having a perimeter of a dimension substantially double that of the length of said edge, and said faces being shaped so as to form a rectangle in any cross-sectional plane parallel to said second and third planes, said rectangle formed in any said cross-sectional plane parallel to said second and third planes having a perimeter equal to the perimeter of said circumferential base.

8. Apparatus according to claim 7; in which said guiding means further includes a second section having a second set of two apices, and edge means for connecting each of said four apices of said first section to the nearest apex of said second section.

9. Apparatus according to claim 8, in which a first two of said apices of said first set are connected together by a first element and the remaining two of said apices of said first set are connected together by a second element for forming said circumferential base of said portion of said tube and said two apices of said second set define said straight edge along a line connected therebetween in which said straight edge is parallel to said first and second elements.

10. Apparatus according to claim 9, in which each said first and second element is a rigid straight bar.

11. Apparatus according to claim 9, in which said apparatus further comprises adjusting means for adjusting the length of the sides of the rectangular configuration and the length of the straight edge.

12. Apparatus according to claim 11, in which the adjusting means includes means for simultaneously adjusting the position of each apex of said first set of apices of the guiding means so as to adjust the length of sides of the base without displacing the center of that base, and means for adjusting the position of each apex of said second set of apices so as to adjust the length of the straight edge without displacing the center of that edge.

13. Apparatus according to claim 9, further comprising two substantially rigid and straight guiding elements disposed outside the tube for forming two sides of the base of said portion of the tube, which two sides are orthogonal to the straight edge.

14. Apparatus according to claim 13, in which each said external guiding element is constituted by a roller rotatably mounted on an axis.

15. Apparatus according to claim 14, in which the axes of the rollers are connected together, at each end thereof, by a respective connecting element.

16. Apparatus according to claim 15, in which each of said connecting elements is constituted by a straight telescopic bar.

17. Apparatus according to claim 9, in which said tube of material is produced in a circular knitting machine including a circular guide and an output device having a pair of drive rollers, said output device being situated downstream of said guide on the route of said tube of material in which said drive rollers define a starting line where the tube of material is flattened, this line being co-planar with and perpendicular to the axis of the guide, wherein the straight edge substantially coincides with the starting line of the output device and the base is arranged coaxially with the guide.

18. Apparatus according to claim 8, in which said edge means includes at least one straight telescopic bar.

19. Apparatus according to claim 9, in which each of said first and second elements is constituted by a straight telescopic bar.

* * * * *